United States Patent [19]

Adamson

[11] 3,942,732

[45] Mar. 9, 1976

[54] THREAD CUTTER FOR WINDING MACHINES AND THE LIKE

[75] Inventor: Fletcher D. Adamson, Alexander City, Ala.

[73] Assignee: Russell Corporation, Alexander City, Ala.

[22] Filed: Jan. 20, 1975

[21] Appl. No.: 542,360

[52] U.S. Cl. ..... 242/19; 242/36; 242/37 R; 242/39

[51] Int. Cl.[2] ..... B65H 75/32; B65H 63/08

[58] Field of Search ..... 242/19, 36, 37, 38, 39, 242/40; 57/86, 87; 225/33, 60, 63, 59, 77, 79, 82, 84, 85, 90, 91, 92, 93

[56] References Cited

UNITED STATES PATENTS

| | | | |
|---|---|---|---|
| 1,122,083 | 12/1914 | Dixon | 242/19 |
| 1,143,003 | 6/1915 | West | 242/19 |
| 1,443,875 | 1/1923 | Glazier et al. | 242/39 |
| 1,498,252 | 6/1924 | Vickers | 242/39 |
| 2,140,156 | 12/1938 | Harschnek | 225/33 X |
| 3,526,348 | 9/1970 | Morrocco et al. | 242/19 X |

FOREIGN PATENTS OR APPLICATIONS

| | | | |
|---|---|---|---|
| 952,571 | 5/1949 | France | 242/39 |
| 1,084,734 | 7/1954 | France | 242/36 |
| 879,880 | 10/1961 | United Kingdom | 242/36 |

*Primary Examiner*—Stanley N. Gilreath
*Attorney, Agent, or Firm*—Jennings, Carter & Thompson

[57] ABSTRACT

Means associated with a yarn package building mechanism such as a winder automatically to assure that the package is built to a predetermined diameter, thus assuring that such packages are efficiently used in subsequent processes. The invention provides a simple, economical attachment which may be placed on existing winders and other package builders without major change therein. The mechanism incorporates a knife which is engaged by the oscillating thread as it is level wound onto the package, the knife being raised as the package is built, so that finally the thread engages the knife and is cut, thus stopping the building of the package.

2 Claims, 6 Drawing Figures

THREAD CUTTER FOR WINDING MACHINES AND THE LIKE

This invention relates to apparatus for building uniform size packages of yarn on winding machines and similar mechanisms used in the textile arts.

In the art to which this invention relates there is a need for uniform packages of yarn in textile operations. For instance, when packages of yarn are to be wound on warp beams for weaving it is desirable that the packages contain substantially the same number of linear feet of yarn so that when the ends are wound on the beam there will be a minimum of wastage of yarn due to some of the packages having more or less yarn that others. If one package contains less linear footage of yarn than the remaining packages the winding on the beam has to cease when the first package is used up, thereby resulting in waste of the remaining yarn on the other packages.

My invention contemplates a simple, readily adaptable cut-off member for the yearn in the form of a knife. The knife is so mounted that when the package builds up to a certain diameter the knife thereby is automatically brought into position to be engaged by the oscillating yarn as it level winds on the package. This severs the yarn and stops the building of the package.

More in detail, my invention contemplates mechanism of the character designated which may consist essentially of an arm which is pivoted adjacent its upper end, preferably below one side of the cradle for the package. As will be understood, the cradle itself is mounted for pivotal movement about a stationary shaft carried by the frame of the machine so that as the package builds in size the end of the cradle carrying the spool for the package moves upwardly. On the end of the arm I secure a knife holder and a knife, preferably as herein described, the holder having an upwardly opening notch with a cutting edge or edges of the knife or knives forming a side of the notch. Secured to the pivoted arm intermediate its ends is a vertical arm which has a portion extending over a side of the package cradle. Adjustment means in the form of a bolt or the like is provided between the vertical arm and the cradle so that as the package approaches a predetermined size the adjustable stop carried by the vertical arm is engaged by the cradle, thereby to raise the pivoted arm and hence the knife. In view of the fact that the thread is being oscillated back and forth longitudinally of the package for level winding purposes, as soon as the entrance end of the notch in the knife holder reaches the level of the thread, the thread is trapped therein on one of its oscillating motions, engages the knife, and is severed.

Apparatus illustrating features of my invention is shown in the accompanying drawings forming a part of this application in which.

Figure 1:
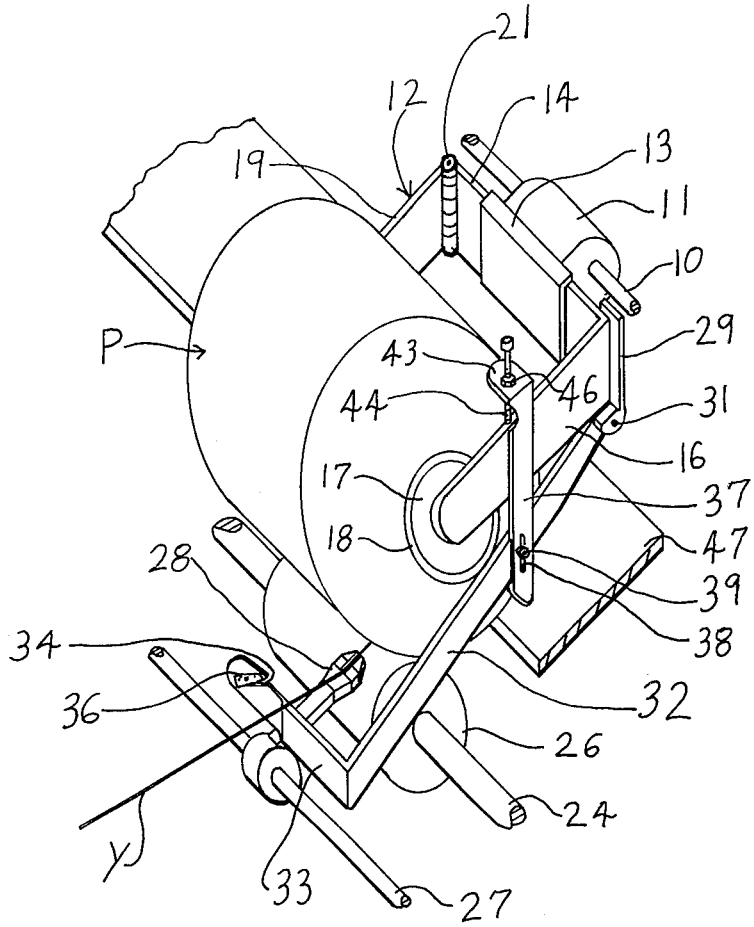
FIG. 1 is a somewhat fragmental, diagrammatic isometric view showing my invention applied to a package building station of a winding machine at which a package of yarn is being wound.

Referring now to the drawings for a better understanding of my invention I show the same in association with one package building section or station of an existing winding machine. Thus, the winding machine in question may incorporate a longitudinally extending rod 10 secured to the end frames, not shown. Pivotally surrounding the shaft 10 is a support housing 11 for a package cradle which is generally indicated by the numeral 12. The cradle 12 may comprise the rearmost piece or block 13 secured in suitable fashion to the member 11. The cradle also incorporates a rear plate or leg member 14 and integrally formed with member 14 is an arm 16. Mounted in the forward end of the arm 16 is a bearing member 17 which is adapted rotatably to receive one end of a cone, spool, bobbin or the like 18 on which the yarn Y is to be wound, thus to form the package P as shown in the drawings.

Figure 2:
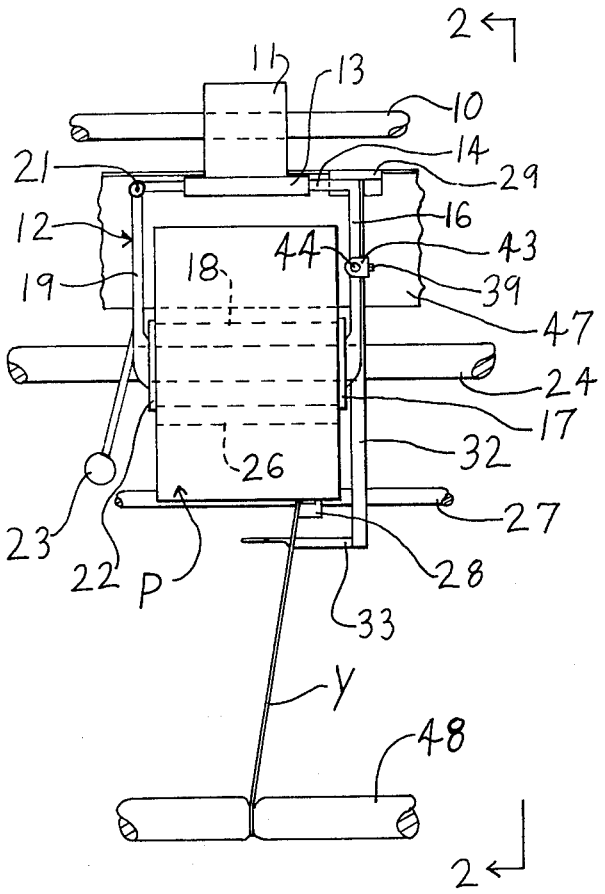
FIG. 2 is a plan view partly broken away and in section.
Figure 3:
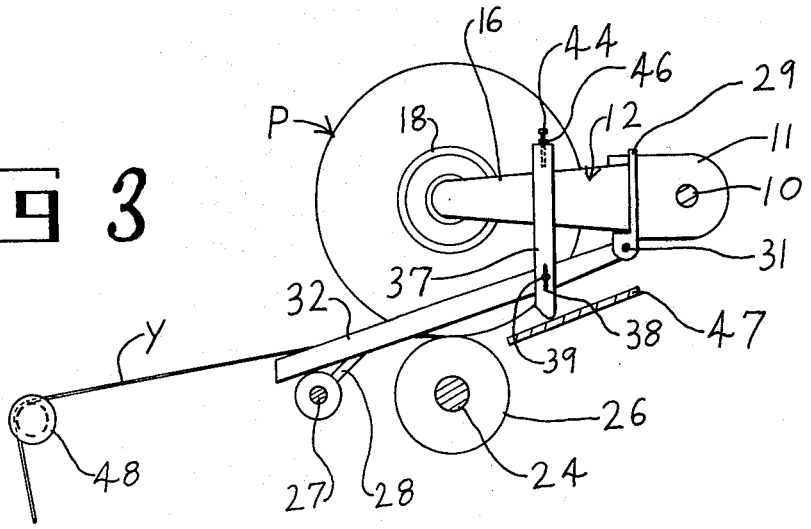
FIG. 3 is a detail sectional view taken along line 2—2 of FIG. 1.

The other leg or side 19 of the cradle 12 may be pivotally mounted as at 21 to the back plate member 14. This leg or side of the cradle also carries a bearing member 22 adapted to fit into the opposite end of the cone or the like 18. A handle 23 is secured to the side 19 so that when doffing the package the entire side 19 may be pivoted outwardly, namely, to the left as viewed in FIG. 2, so that the package may be removed.

The apparatus also includes a driven shaft indicated at 24. Beneath each package to be formed is a drum 26 against which the periphery of the spool, bobbin or the like engages so that it is rotated, the drum thus being effective to drive the package throughout its formation and as it builds up.

Also carried by the machine and as a standard part thereof is a traversing rod 27. Each station is provided with a thread guide 28, secured to the traversing rod 27. As the yarn feeds onto the package the rod oscillates back and forth, moving the guide 28, thus level winding the yarn on the package.

The foregoing represents generally and in diagrammatic fashion one form of winding apparatus with which my invention may be associated. As will later appear, my invention may with equal facility be associated with various kinds of apparatus in which the package is built up by winding yarn thereon and wherein it is desired to stop the building of the package when the package reaches a predetermined diameter.

My invention may conveniently be applied to the apparatus shown by mounting a plate 29 adjacent the rear of the arm 16. The plate 29 pivotally receives as at 31 one end of a knife arm 32. The arm 32 has a transversely extending knife carrying end portion 33 having an open mouth notch 34 therein.

For reasons later to be explained, mounted on each side of the arm 33 and associated with the notch 34 so as to have their cutting edges form one side of notch and to engage the yarn are razor blade-like knives 36. The knives are accurately located and held in place by a bolt 35, and 35$^{a}$ therefor and pins 35$^{b}$.

Figure 4:
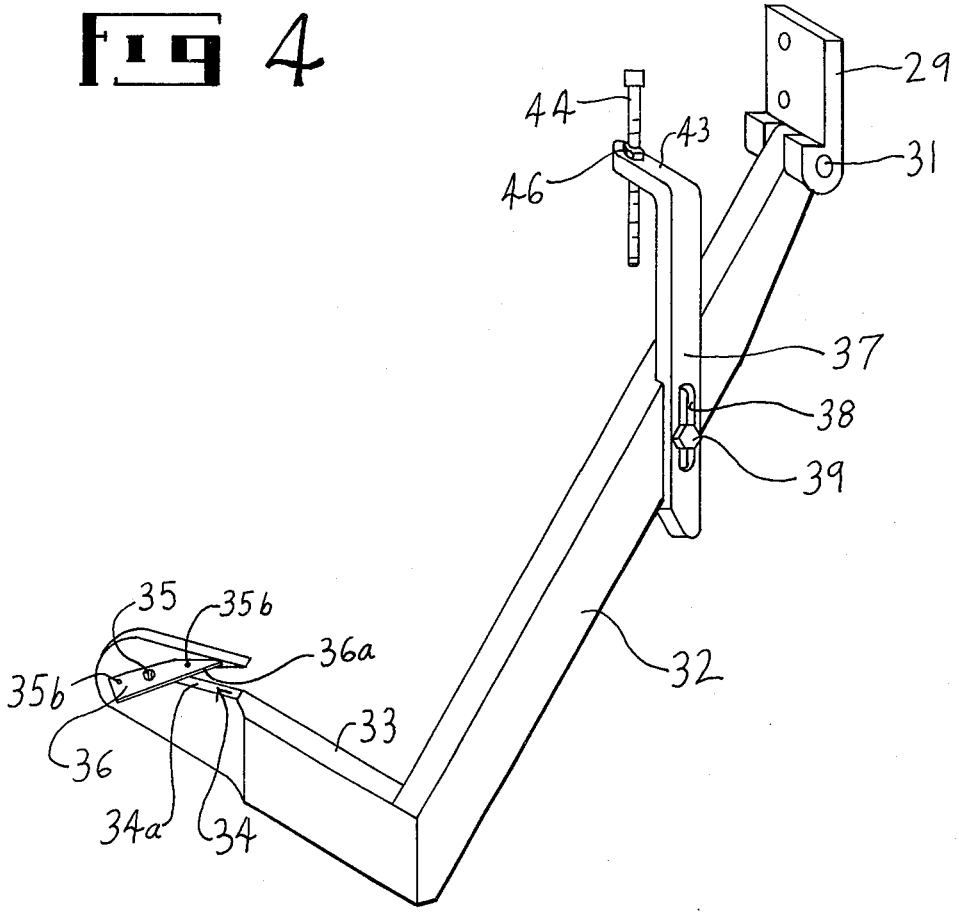
FIG. 4 is an isometric view to an enlarged scale of the knife carrying arm.

Intermediate the ends of the knife arm 32 I adjustably secure thereto an arm 37. As shown in FIG. 4, the arm 37 is provided adjacent its lower end with a longitudinally extending slot 38. A stud 39 passes through the arm 32 and may be threaded into the arm 32 to secure the parts adjustably together.

At its upper end the arm 37 is provided with an inturned section 43. Threaded through the section 43 is a bolt 44 which may be held in vertically adjusted position relative to the end 43 by means of a nut 46.

From the foregoing the method of constructing and using my improved apparatus together with the several advantages thereof may now be more fully explained and understood. First, it will be understood that the yarn Y may be delivered to the thread guide 28 by passing over a leading roller 48 or the like so that the yarn is fed generally horizontally to the bottom of the package. Also, as will be remembered, the traversing rod 27 moves the yarn guide 28 back and forth so that as the roller 26 drives the package the yarn is level wound thereon.

In adjusting my mechanism for the job at hand, the first adjustment is to loosen stud 39 and adjust the arm 32 so that its outer end 33 is supported free of the oscillating traverse rod. The stud 39 is then tightened and the lower end of the arm 37 is permitted to come to rest on the plate or other member 47. Next, using a package of yarn of the desired diameter I insert it in the cradle and then adjust the position of the bolt 44 until the traversing yarn will just enter notch 34. The nut 46 is now tightened so that the parts are secure.

With the parts thus adjusted a cone, bobbin or the like 18 is inserted in the cradle, the yarn end is placed through the yarn guide and its end is wrapped around the cone. The apparatus is now started, the roller 26 driving the cone, and the package commences to be built up. When the package reaches the desired diameter the top edge of the cradle arm 16 engages the lower end of the bolt 44, raising the arm 32, thereby raising its outer end 33 which carries the knives 36. As soon as the package reaches the final desired diameter, on one of the sweeps of the traversing mechanism the yarn will be trapped by the open mouth notch and pulled downwardly and into contact with the knives.

As heretofore indicated, I use two knives, one on the front side and one on the rear side of the slot. The reason for this is that I have discovered that without both of these knives the moving yarn oftentimes fails to be cut. By noting what has happened, the two knives cooperate with each other inasmuch as the outside knife, that is to say, the one on the side from which the yarn is being fed, serves more or less to wedge the yarn in place and the cutting almost always is done by the knife on the inside of the arm section 33. This action can be understood when it is realized that the yarn not only is being traversed to the left as seen in FIG. 1 when the cutting takes place, but also is moving at a considerable rate of speed, axially. In actual practice I have observed that with only one knife 36 the yarn sometimes will traverse into the slot and then out of the slot without being cut, in other instances it would be partially cut, and in other instances would not be cut until the package had built up considerably more than the desired diameter. In any event, the use of the two knives is an important feature of my invention and in practice eliminates the need for movable, sissors-type cutters for the yarn.

Figure 5:
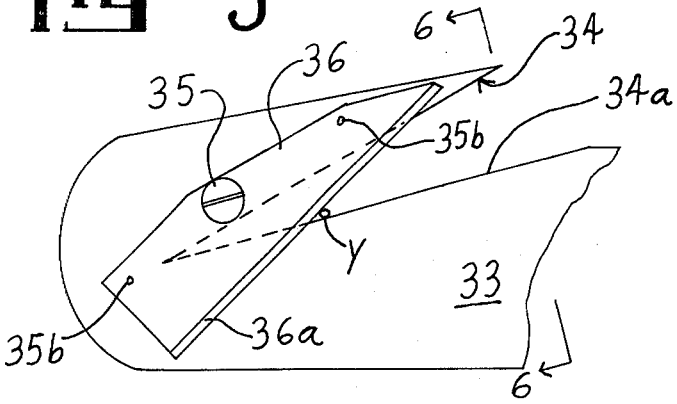
FIG. 5 is a fragmental, front view of the knife carrying end of the arm drawn to an enlarged scale.
Figure 6:
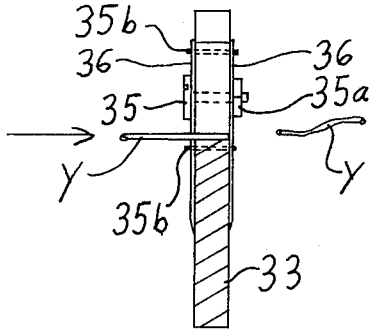
FIG. 6 is a detail sectional view taken along the line 6—6 of FIG. 5.

It will be noted that the cutting edges 36$^a$ of the knives form with the bottom wall 34$^a$ what might be termed a V-shaped cutting notch. See particularly FIG. 5. The knives are, as shown, in tandem, spaced apart, and have their cutting edges parallel. The yarn is effectively severed by this arrangement as stated.

In view of the foregoing it will be apparent I have devised an improved, simple and efficient apparatus which may readily be attached to winding machines and the like to assure the building thereon of packages of constant size. As of the date of filing this application I have installed on what is known in the trade as the Hamel Twister some 240 of the devices incorporating features of my invention. These have proven to be practical, trouble-free, and satisfactory in every way. Also, by actual measurement of packages made with my improved apparatus I find that I can consistently produce packages of yarn weighing an average of 5.85 pounds per package with a weight variation of no more than one-half of one per cent. Using uncontrolled, "eyeball" doffing the weights of the packages from this same machine prior to the installation of my invention thereon had run anywhere from 5½ to 6½ pounds, even though the machines were tended by skilled operators. In addition to the foregoing the use of my invention greatly reduces the amount of labor required to tend this type of machine and this is because the operator merely has to pass down the aisle between the machines and note whether or not an end is down. When the end is down the operator knows that the package is ready to be doffed.

While I have shown my invention in but one form, it will be obvious to those skilled in the art that it is not so limited, but is susceptible of various changes and modifications without departing from the spirit thereof.

What I claim is:

1. The combination with yarn winding apparatus and the like including means to build a package of yarn and means to oscillate the yarn as the package is built thereby to level wind the yarn on the package of:

a. means to cut the yarn while it is being fed to said package, comprising
   1. a pivoted arm having an end portion extending beneath the yarn in the area where it is to be cut,
   2. yarn severing means carried by said end portion of the arm and comprising
   3. a notch in the end of the arm,
   4. two stationary knives, one located on one side of the arm and the other on the other side thereof,
   5. said knives being located to form with said notch a wedge-shaped opening into which the yarn is pulled upon oscillation toward the apex of said opening whereby one knife engages and holds the yarn while the other knife cuts the same upon continued and further oscillation of the yarn, and
b. means to raise the knife-carrying end of the arm to place said wedge-shaped opening in yarn receiving position in response to the completion of a yarn package of predetermined diameter.

2. In apparatus for building a package of yarn, said apparatus embodying:

a. a cradle for the package having arms for rotatably receiving between them a cone or the like on which the yarn is to be wound, thus to build the package,
b. means pivotally mounting the cradle in a fashion to permit the ends of the arms carrying the package to move upwardly responsive to increase in diameter of the package, and
c. means to rotate the package and to level wind the yarn thereon by oscillating the yarn to and fro relative to the longitudinal axis of the package, the improvement comprising:
   1. an arm having one end pivotally mounted adjacent the pivoted ends of the cradle arms, 2. a laterally turned end on the pivoted arm positioned to lie below the path of the oscillating, on-coming yarn,
3. there being an open mouth notch in the upper surface of the laterally turned end of the pivoted arm,
4. two razor blade-like knives carried by the arm, a first one being located on one side of said laterally turned end of the arm and a second one on the other side thereof, the cutting edges of said knives being substantially parallel, and
5. means carried by the pivoted arm having a portion located in the path of upward movement of an arm of the cradle and effective when the package reaches a predetermined diameter to raise the mouth of said notch into the path of the oscillating yarn, thus to cut the yarn.

* * * * *